United States Patent [19]

Pascarella

[11] 3,963,063

[45] June 15, 1976

[54] VISCOUS LIQUID TRANSFER DEVICE

[76] Inventor: Robert S. Pascarella, 600 B Kelly Ave., Pittsburgh, Pa. 15221

[22] Filed: Aug. 28, 1974

[21] Appl. No.: 501,147

[52] U.S. Cl. ..... 141/309; 141/364

[51] Int. Cl.[2] ..... B65B 3/06

[58] Field of Search ..... 141/285, 290, 297, 298, 141/300, 309, 310, 311, 363, 364, 365, 367, 369, 375, 391

[56] References Cited

UNITED STATES PATENTS

| | | | |
|---|---|---|---|
| 2,694,515 | 11/1954 | Green | 141/300 |
| 2,850,050 | 9/1958 | Connolly | 141/300 X |
| 3,156,272 | 11/1964 | Indrunas | 141/309 X |

FOREIGN PATENTS OR APPLICATIONS

| | | | |
|---|---|---|---|
| 823,265 | 10/1949 | Germany | 141/311 |

*Primary Examiner*—Richard E. Aegerter
*Assistant Examiner*—Frederick R. Schmidt
*Attorney, Agent, or Firm*—William J. Ruano

[57] ABSTRACT

A viscous liquid transfer device for emptying partially filled bottles of ketchup mustard, etc. in restaurants to make a full bottle. The device comprises an upwardly and downwardly flared cylinder having attached, to an inner wall surface, a vent tube which extends into the bottle to be emptied while inverted with its neck supported on the upwardly flared portion, while the downwardly flared portion rests on the neck of the bottle to be filled.

1 Claim, 2 Drawing Figures

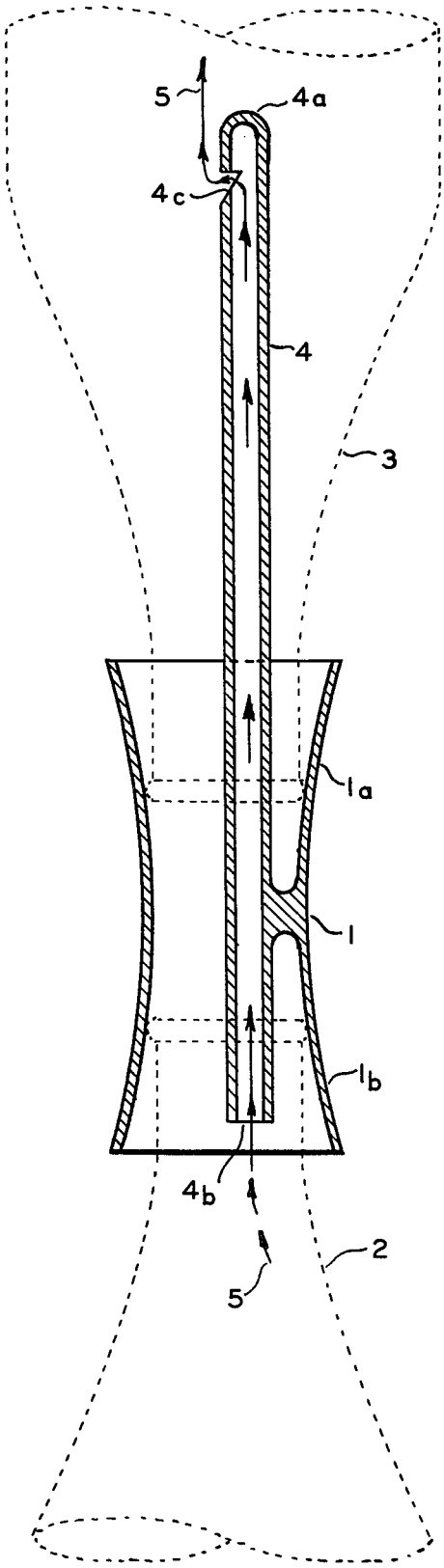
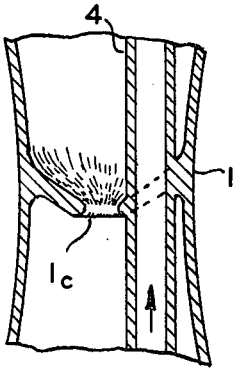
FIG. 2
FIG. 1

VISCOUS LIQUID TRANSFER DEVICE

This invention relates to a viscous liquid transfer device and, more particularly, to one for emptying partially filled ketchup and mustard bottles and the like into a bottle to be filled thereby.

In the past, liquid transfer devices have been proposed for emptying almost emptied ketchup and mustard containing bottles and the like into another bottle to provide a full bottle which is more attractive to the average restaurant patron. However, these devices have not come into popular use because of their complicated construction and expensive cost of manufacture, as well as their ineffectiveness to speedily and completely empty the bottles.

An object of my invention is to provide a novel liquid transfer device which will overcome the abovenamed disadvantages, which is relatively simple and inexpensive in construction and which will more efficiently and speedily empty a partially filled bottle into another bottle which will be completely filled.

Another object of the present invention is to provide an improved puncturing and venting tube having a dual function and which effects far speedier and more complete emptying of a partially filled ketchup bottle or the like than heretofore possible.

Other objects and advantages will become more apparent from a study of the following description taken with the accompanying drawing wherein:

FIG. 1 is a vertical, cross-sectional view of a viscous liquid transfer device embodying the present invention; and, FIG. 2 is a modification.

Referring more particularly to FIG. 1 of the drawing, numeral 1 generally denotes a liquid transfer device of substantially cylindrical construction except that the top portion 1*a* is flared upwardly while the bottom portion 1*b* is flared downwardly. The device can be made of any suitable material, preferably plastic material or possibly of glass or metal, such as stainless steel or aluminum.

Into the upwardly flared portion 1*a* there is inserted the neck of an inverted, partially filled ketchup or mustard bottle, shown in dotted lines, identified by numeral 3, and into the lower flared portion 1*b* there is inserted the neck 2 of a bottle to be filled with the contents of bottle 3. Integrally molded to the central inner wall portion of the device 1 is a vent tube 4 having a protective top covering 4*a* and having an opening 4*c* in the adjacent side thereof so that the ketchup or mustard does not enter the tube 4 while bottle 3 is being emptied.

In operation, when the bottle 2 to be filled and the bottle 3 to be emptied are positioned as shown in dotted lines in the drawing, as the ketchup or other contents pours downwardly from the mouth of bottle 3 and into that of bottle 2, it will displace air which will flow upwardly into the bottom end 4*b* of the tube in the path of the arrows identified by numeral 5 and eventually flowing outwardly and upwardly from opening 4*c* so as to break any possible vacuum in bottle 3 above such opening, therefore allowing the contents of bottle 3 to freely flow downwardly at a quick rate through the device 1 and into bottle 2. After bottle 2 is filled other bottles may be similarly filled from partially emptied bottles such as 3.

FIG. 2 shows a modification wherein instead of integrally attaching tube 4 to the inner wall of device 1, a downwardly flared rim or funnel 1*c*, integrally extending from the inner wall of device 1, may be provided, through which tube 4 extends in an integral manner as shown, or detachably by a slip fit (not shown).

While I have illustrated and described several specific embodiments of my invention, it will be understood that these are by way of illustration only and that various changes and modifications may be contemplated in my invention and within the scope of the following claims.

I claim:

1. A viscuous liquid transfer device comprising a tubular element arcuately flared both upwardly and outwardly as well as downwardly and outwardly from a central portion thereof to accomodate varying sizes of the necks of a bottle to be emptied and one to be filled, respectively, a funnel shaped ring integrally extending from and integrally molded with the inner wall of the central portion of said device, a vent tube extending vertically through a portion of said funnel shaped ring, and having an upper portion extending above said tubular element well into the neck of the bottle to be emptied, and a lower portion totally enclosed in said tubular element whereby it will pierce the contents of the bottle to be emptied, the top portion of said vent tube being closed and a vent opening being provided in the side of the vent tube adjacent to the top portion.

* * * * *